US006874196B2

(12) United States Patent
Kato et al.

(10) Patent No.: US 6,874,196 B2
(45) Date of Patent: Apr. 5, 2005

(54) REED CLEANING APPARATUS FOR AIR-JET LOOM

(75) Inventors: Takatsugu Kato, Tokyo (JP); Hiroyasu Matsumoto, Ishikawa-ken (JP)

(73) Assignees: Takayama Reed Co., Ltd., Kanazawa (JP); Tagawa Kikai Ltd., Kanazawa (JP)

( * ) Notice: Subject to any disclaimer, the term of this patent is extended or adjusted under 35 U.S.C. 154(b) by 421 days.

(21) Appl. No.: 10/223,455

(22) Filed: Aug. 20, 2002

(65) Prior Publication Data

US 2004/0034960 A1 Feb. 26, 2004

(51) Int. Cl.[7] ..... D03J 1/00; A47L 5/14
(52) U.S. Cl. ..... 15/301; 15/312.1; 139/1 C
(58) Field of Search ..... 15/300.1, 301, 15/308, 312.1, 312.2, 345, 346, 363, 383; 139/1 C, 192

(56) References Cited

U.S. PATENT DOCUMENTS 3,045,274 A * 7/1962 Sohler ..... 15/312.2
3,153,803 A * 10/1964 Bahnson, Jr. ..... 15/312.1
4,527,596 A 7/1985 Kagi ..... 139/1 C
4,640,316 A * 2/1987 Wakai ..... 139/1 R
4,895,186 A * 1/1990 Shaw ..... 139/1 C
5,279,334 A 1/1994 Takegawa ..... 139/1 C
5,353,467 A * 10/1994 Junger ..... 15/312.2
5,666,996 A * 9/1997 Bollier et al. ..... 139/1 C
6,371,168 B1 4/2002 Kozlowski ..... 139/1 C

FOREIGN PATENT DOCUMENTS

EP 0 128 256 12/1984
JP 61-83357 4/1986

* cited by examiner

*Primary Examiner*—Terrence R. Till
(74) *Attorney, Agent, or Firm*—Westerman, Hattori, Daniels & Adrian, LLP

(57) ABSTRACT

A reed cleaning apparatus is provided with rotary brushes (16) supported on a carriage (3) that travels along the upper bar (2) of a reed for rotation about an axis parallel to guide groove (17) formed in the reed. Flexible shafts (15) are used to transmit rotative force to the rotary brushes (16) to form the reed cleaning apparatus in compact construction, to dispose the rotary brushes close to the reed, to form the rotary brushes in a small diameter, and to enable cleaning the reed with warp yarns extended through the reed by depressing the warp yarns. The rotary brushes are disposed at the opposite longitudinal ends, respectively, of the carriage (3) to enable the reed cleaning apparatus to clean the entire length of the reed.

4 Claims, 4 Drawing Sheets

REED CLEANING APPARATUS FOR AIR-JET LOOM

BACKGROUND OF THE INVENTION

1. Field of the Invention

The present invention relates to a cleaning apparatus for cleaning dents of a reed forming a guide groove for guiding a weft yarn and air currents for carrying the weft yarn in the front surface of a reed, i.e., the so-called tunnel reed, for an air-jet loom. The cleaning apparatus moves along the the reed, i.e., in a longitudinal direction of the air-jet loom, to remove flies adhering to the dents of the reed.

2. Prior Art

The reed of a loom is formed by arranging a plurality of pieces of the reed having a dent at small intervals to form small gaps to pass warp yarns. A tunnel reed for an air-jet loom is provided with a guide groove for guiding a weft yarn and air currents for carrying the weft yarn in the front surface thereof. While the air-jet loom is in weaving operation, a weft yarn flies along the guide groove of the tunnel reed, and the weft yarn thus inserted is pushed by the bottom of the guide groove and is beaten into the cloth fell of a fabric on the air-jet loom. Short, fine waste fibers generally called flies produced from the weft yarns and the warp yarns during inserting and beating operations adhere to the tunnel reed. Although most part of the flies are removed from the reed by the rubbing action of the warp yarns exerted on the dents and the strenuous movement of the reed, some part of the flies remains on the reed, and the amount of the flies remaining on the reed increases naturally as weaving time increases.

Flies adhering to parts forming the guide groove of a tunnel reed reduce the velocity of an air jet jetted to insert a weft yarn. Parts of the front edges of dents forming the guide groove are finished in smooth surfaces to reduce resistance against the inserting air jet flowing through the guide groove to the least possible extent. Fly wastes adhering to parts of the front edges of the dents forming the guide groove form fine fluffs on the parts of the front edges of the dents forming the guide groove, and the fine fluffs exert a high resistance on the inserting air jet.

As well-known, the air-jet loom uses a high-velocity air jet for inserting. Since air has a small mass and a small inertia and the guide groove is filled with the atmosphere, the air jet diffuses and decelerates rapidly. Consequently, the yarn-carrying force of the air jet decreases sharply. Therefore, a plurality of auxiliary nozzles are arranged in front of the front edges of the dents and auxiliary air jets are jetted obliquely toward the guide groove through the auxiliary nozzles to assist the inserting air jet in carrying a weft yarn.

An air-jet loom, as compared with a water-jet loom and a rapier loom, consumes great power for a weaving operation because the generation of the air jet for carrying a weft yarn requires a great deal of power. Therefore, if the resistance of the guide groove against the air jet is increased by flies adhering to the reed, the force of the air jet must be enhanced to overcome the resistance and, consequently, the power consumption of the loom for weaving is further increased.

Flies adhering to the parts of the dents of the tunnel reed forming the guide groove must timely be removed to solve the foregoing problems attributable to the adhesion of flies to the tunnel reed. A conventional cleaning device as shown in FIG. 4 has been used to clean a tunnel reed.

Referring to FIG. 4, the conventional cleaning device has a carriage 3 set on the upper bar 2 of a reed 1 so as to move lengthwise along the upper bar 2, a rotating shaft 31 extended downward from the carriage 3 in parallel to the front surface of the reed 1, and a buff 32 attached to the lower end of the rotating shaft 31. A rotative driving unit for driving the rotating shaft 31, wheels and a running gear for the carriage, which are not shown, are built in the carriage 3. A section on the side of the reed 1 of a peripheral part of the buff 32 is inserted in a guide groove 17 formed in the tunnel reed 1. While the carriage 3 is traveling along the tunnel reed 1, the buff 32 is rotated so as to rub parts forming the guide groove 17 of the dents of the tunnel reed 1 in a direction perpendicular to the dents to remove flies adhering to the parts forming the guide groove 17 of the dents.

The buff 32 of the conventional cleaning device rubs the parts forming the guide groove 17 of the dents in the flowing direction of a weft yarn carrying air stream. Consequently, the parts forming the guide groove 17 of the dents are smoothed and flies can be removed to reduce resistance against the flow of the weft yarn carrying air stream. Nevertheless, the power consumption of the loom does not decrease to an expected extent.

A peripheral part of the buff 32 of a big diameter rotating for a cleaning operation in front of the reed 1 interferes with a weft sensor disposed at a position corresponding to the cloth fell, and a yarn end processing device. Thus, the cleaning device is unable to carry out cleaning work unless the reed is removed from the loom, which requires troublesome work.

BRIEF SUMMARY OF THE INVENTION

Accordingly, it is an object of the present invention to provide a cleaning apparatus capable of cleaning a guide groove formed in a tunnel reed for an air-jet loom without removing the tunnel reed from the air-jet loom and with warp yarns extended through the tunnel reed.

It is another object of the present invention to achieve a cleaning operation that reduces the power consumption of the air-jet loom remarkably.

A reed cleaning apparatus according to the present invention includes rotary brushes that rotate about an axis parallel to a guide groove formed in a tunnel reed, i.e., a direction in which a inserted weft yarn travels. The position of the rotary brush or the rotary buff relative to the front surface of a reed is determined by defining the position of the rotary brush on a carriage that travels along the top bar of the reed. Rotative force is transmitted to the rotary brush by a flexible shaft using a wire, so that the shaft of the rotary brush can be disposed close to the front surface of the reed and the rotary brush can be disposed with its rotating axis extended in the guide groove of the reed.

An air jet nozzle for jetting cleaning air against the guide groove formed in the front surface of the reed may be disposed on the front side of the reed with its jetting hole placed close to the rotary brush and a suction nozzle for sucking the cleaning air jetted through the air jet nozzle may be disposed on the back side of the reed with its suction opening located opposite to the jetting opening of the air jet nozzle.

BRIEF DESCRIPTION OF THE INVENTION

Figure 1:
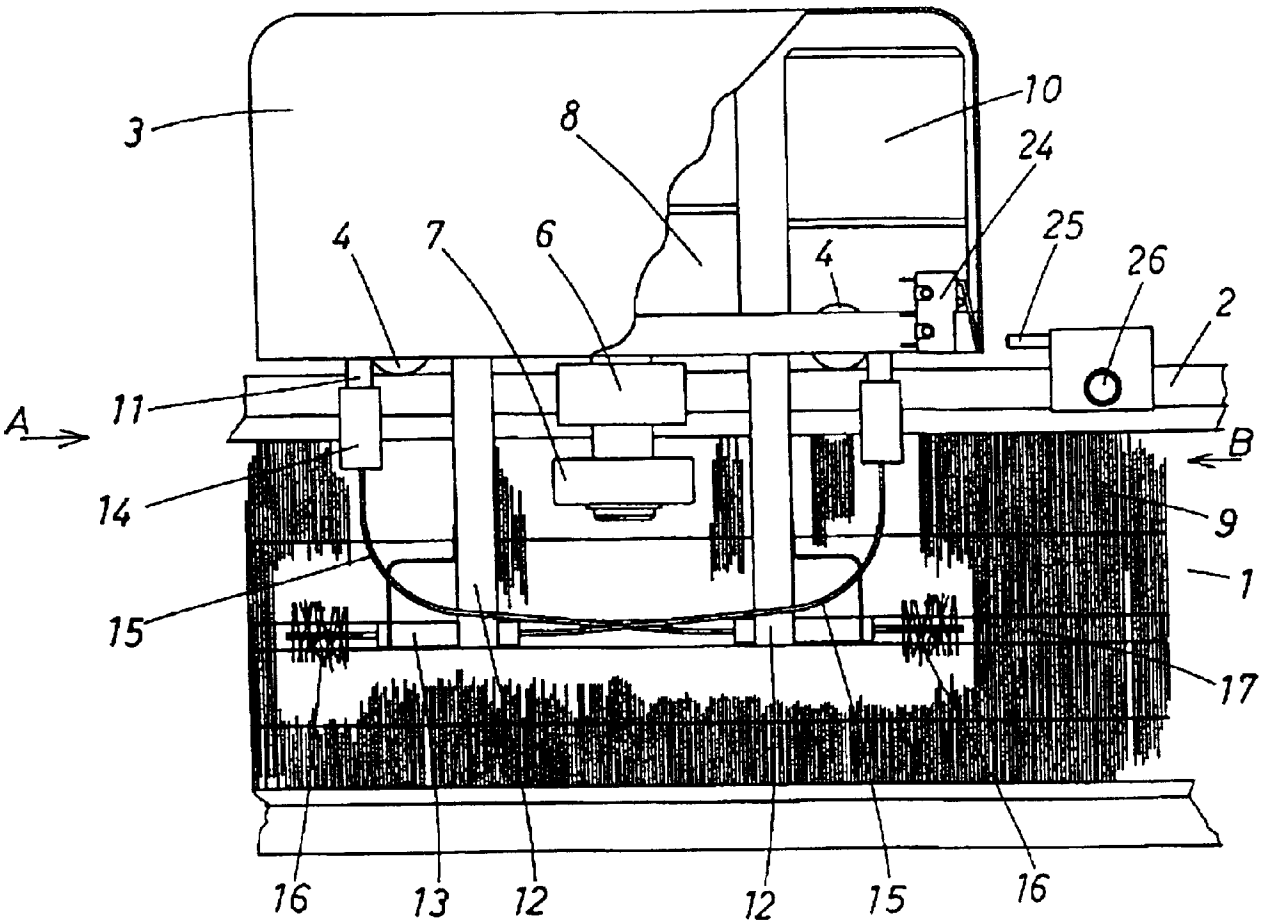
FIG. 1 is a front elevation of a reed cleaning apparatus in a preferred embodiment according to the present invention.

A reed cleaning apparatus of the present invention includes rotary brushes 16 that rotate about an axis parallel to a guide groove 17 formed in a tunnel reed 1, i.e., a direction in which a picked filling yarn travels. Although rotary buffs may be used instead of the rotary brushes, the rotary brushes are more preferable than the rotary buffs because the bristles of the rotary brushes are liable to enter spaces between the dents of the tunnel reed.

The position of the rotary brush 16 or the rotary buff (hereinafter, the rotary brush and the rotary buff will be inclusively referred to as "rotary brush") relative to the front surface of a reed is determined by defining the position of the rotary brush 16 on a carriage 3 that travels along the upper bar 2 arranged over the reed. The carriage 3 is provided with main wheels 4 bearing the weight of the cleaning apparatus, and side wheels 5, 6 and 7 for holding the carriage 3 upright on the upper bar 2. Preferably, the carriage 3 is a self-propelled carriage capable of traveling at a fixed traveling speed and is provided with a driving means for driving one of those wheels. The carriage is moved at a fixed traveling speed to ensure that the entire length of the reed can be uniformly cleaned.

Rotative force is transmitted to the rotary brush 16 by a flexible shaft 15 using a wire, so that the shaft of the rotary brush 16 can be disposed close to the front surface of the reed and, if necessary, the rotary brush 16 can be disposed with its rotating axis extended in the guide groove 17 of the reed. The diameter of the rotary brush 16 is less than 16 mm and is preferably in a range of 12 to 16 mm. Since the rotary brush 16 can be disposed with its rotating axis extended close to the front surface of the reed, the diameter of the rotary brush 16 may be small. The employment of the flexible shaft 15 is effective in forming a power transmission mechanism for transmitting power to the rotary brush 16 in compact construction. Thus, parts of the cleaning apparatus, disposed in front of the reed and at a position in front of a lower part of the reed can be formed in small sizes. Thus, the cleaning apparatus is capable of cleaning the reed carried on the loom. The flies which are accumulated in the guide groove 17 of the reed can be effectively removed by an action of the rotary brush 16 which is disposed within the guide groove 17 and is traveled therethrough. So, the power consumption of the air-jet loom after cleaning can be reduced. The reed can be cleaned with warp yarns extended through the reed when the warp yarns are depressed with a pressing bar 23.

When the cleaning device is used for cleaning the reed on the loom, the cleaning device moves in a limited range corresponding to the length of the reed. The carriage 3 must have a length along the length of the reed to maintain the rotary brush at a correct position relative to the front surface of the reed. Since those restrictions are placed on the cleaning device, a region at least in one end part of the reed cannot be cleaned if the cleaning device is provided with a single rotary brush 16. This problem can be solved by providing the cleaning device with two rotary brushes at the opposite longitudinal ends of the carriage 3, respectively.

An air jet nozzle for jetting cleaning air against the guide groove formed in the front surface of the reed may be disposed on the front side of the reed with its jetting hole placed close to the rotary brush 16, for example, at a middle position between the two rotary brushes 16 when the cleaning device is provided with the two rotary brushes 16, and a suction nozzle for sucking the cleaning air jetted through the air jet nozzle may be disposed on the back side of the reed with its suction opening located opposite to the jetting opening of the air jet nozzle. Plural jetting openings 20 and suction openings 21 may be provided on the front and back sides of the reed, respectively.

When the jetting opening 20 for jetting cleaning air is thus located, the re-adhesion of flies once separated from the edges of the dents by the rotary brush 16 to the dents can be prevented by blowing the flies away by cleaning air. Preferably, a vacuum is created in the suction nozzle to suck the flies blown off the dents by cleaning air through the suction opening 21, and to catch the flies by a filter or the like. Thus, the amount of flies flying in a weaving mill can be reduced.

Figure 2:
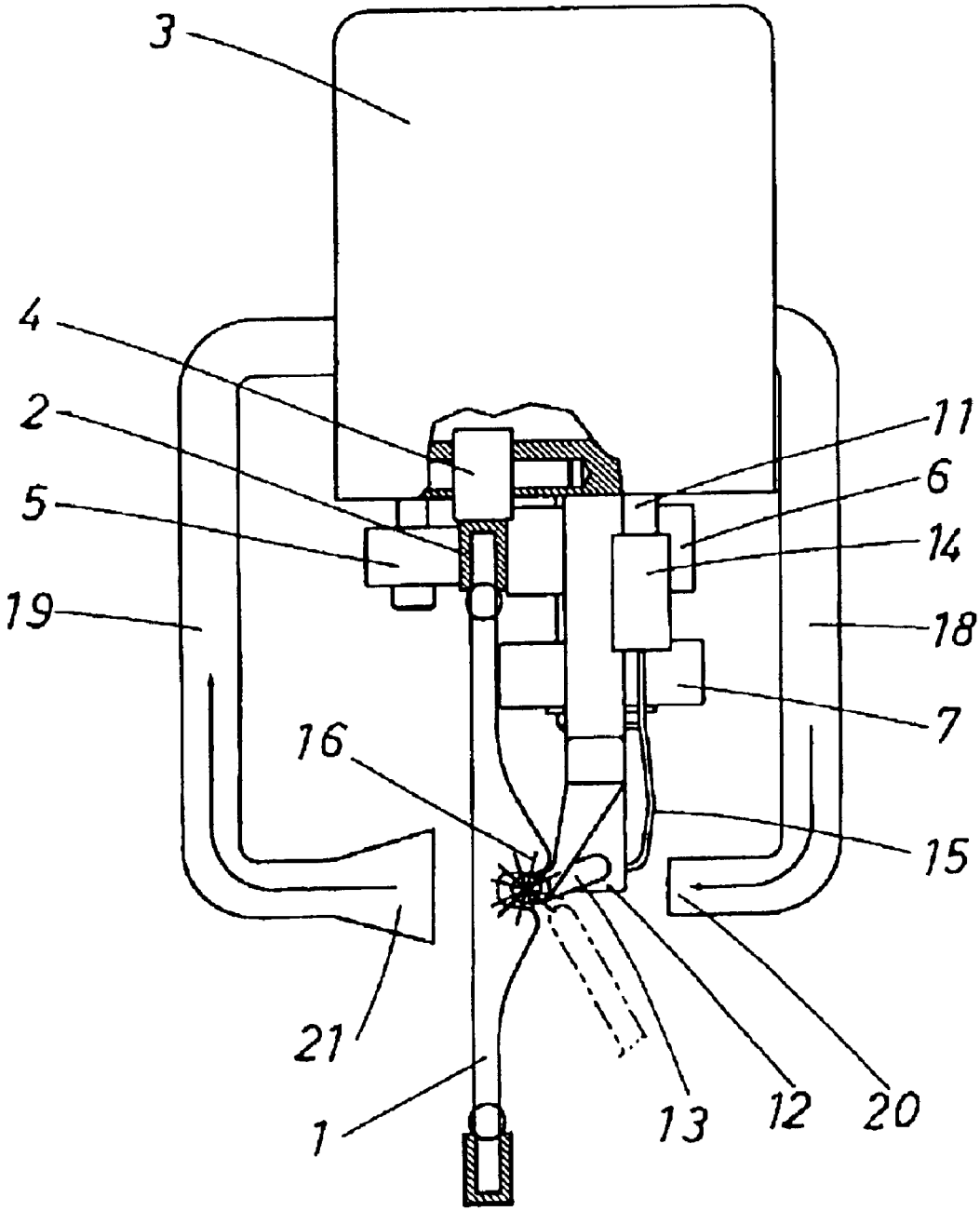
FIG. 2 is a side elevation of the reed cleaning device taken in the direction of the arrow A in FIG. 1.
Figure 3:
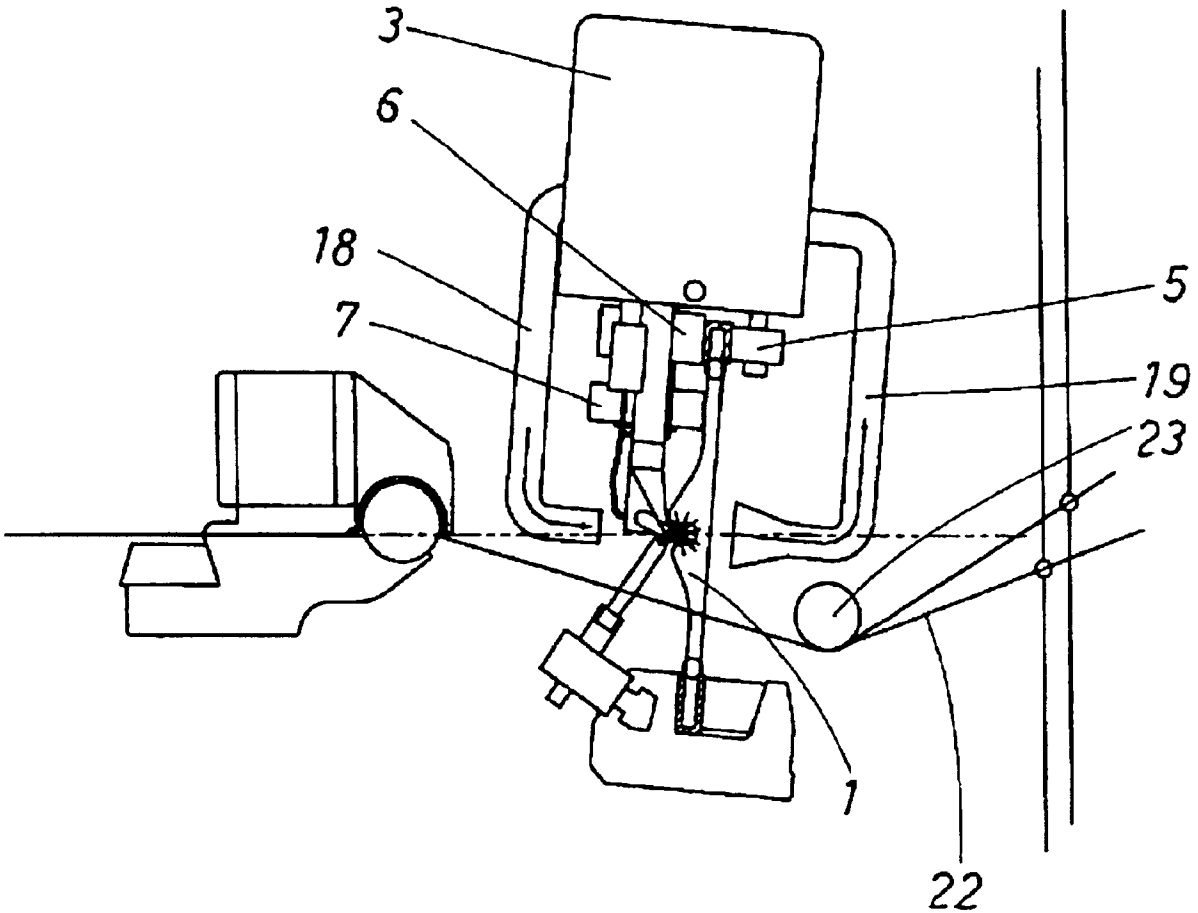
FIG. 3 is a side elevation of the reed cleaning device taken in the direction of the arrow B, in which warp yarns are depressed and the reed cleaning device is in operation.
Figure 4:
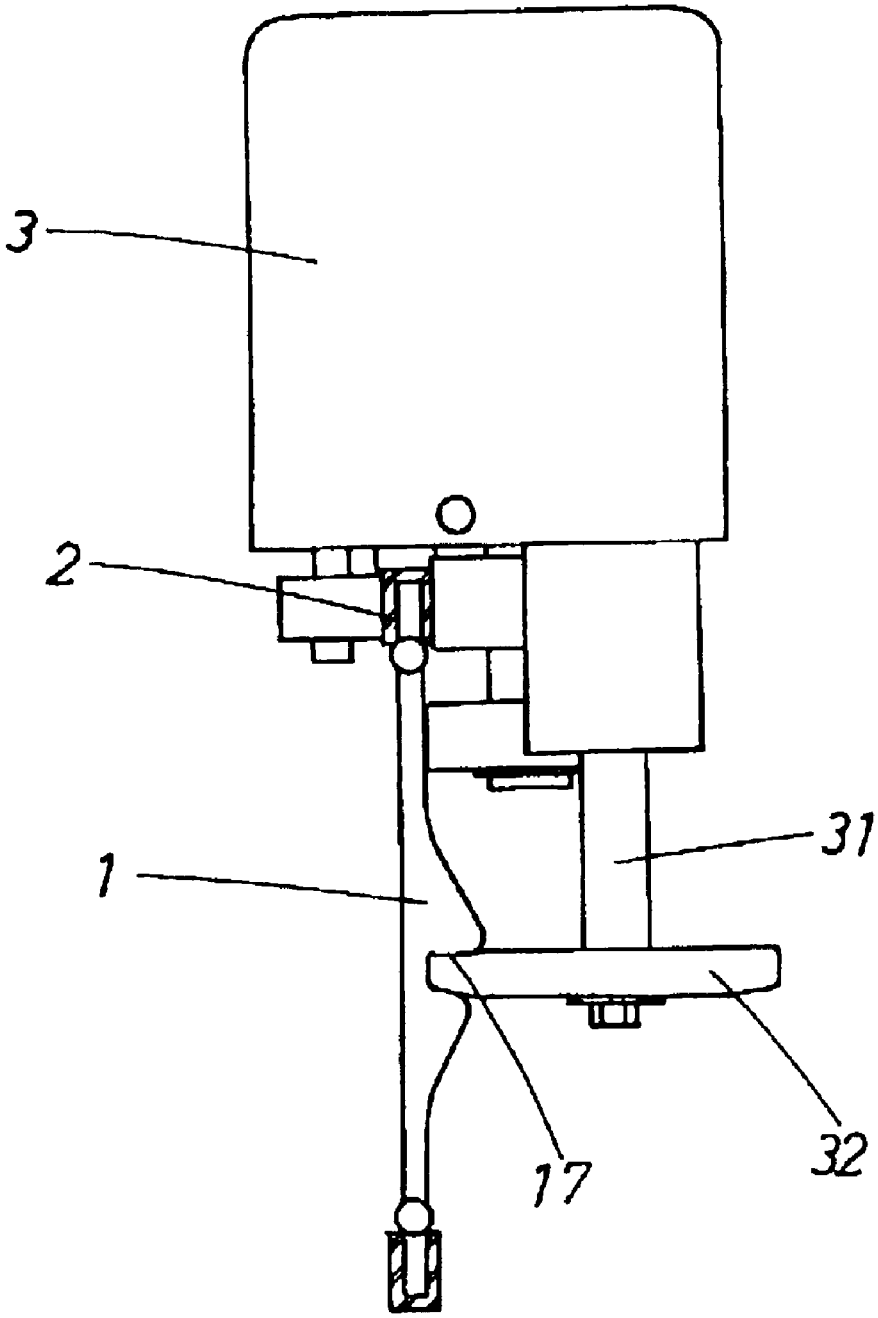
FIG. 4 PRIOR ART
FIG. 4 is a side elevation of a conventional reed cleaning device.

FIGS. 1 to 3 show a reed cleaning apparatus in a preferred embodiment according to the present invention combined with a reed 1. A carriage 3 is placed on an upper bar 2 included in the reed 1 so as to move along the upper bar 2. The carriage 3 is provided with two main wheels 4 spaced a predetermined distance apart with respect to the length of the reed 1, and two back side wheels 5 spaced a predetermined distance apart. A drive wheel 6 is disposed on the front side of the upper bar 2 at a position corresponding to a position between the two side wheels 5. A front side wheel 7 is disposed under the drive wheel 6.

The main wheels 4 rest on and roll along the upper surface of the upper bar 2, and bear the weight of the reed cleaning apparatus. The two back side wheels 5 and the drive wheel 6 are in contact with the opposite sides, respectively, of the upper bar 2. The drive wheel 6 is driven for rotation by a motor 8 to move the carriage 3 along the upper bar 2. The front side wheel 7 in contact with the front edges of the dents 9 of the reed 1 is disposed to prevent the carriage 3 from being tilted by gravity. The drive wheel 6 is formed of rubber. Either the drive wheel 6 or the back side wheels 5 are pushed toward the upper bar 2 and can be manually retracted when the reed cleaning device is mounted on and removed from the reed 1.

Two brush-driving motors 10 are held on the carriage 3 with their output shafts 11 extended downward. Two support rods 12 are extended downward from the carriage 3 in parallel to the front surface of the reed 1. Guide tubes 13 are fixedly held on the lower ends of the support rods 12 so as to extend in parallel to the inserting direction toward the opposite ends of the reed 1, respectively. The base ends of flexible shafts 15 are fixed to the output shafts 11 of the brush-driving motors 10 by couplings 14, respectively. Free end parts of the flexible shafts 15 are passed through the guide tubes 13, and the rotary brushes 16 are fixedly mounted on the free end parts of the flexible shafts 15 projecting from the guide tubes 13, respectively. The flexible shafts 15 are wires, and the rotary brushes 16 are held between the strands of the wires, respectively.

The two individual rotary brushes 16 are held on the carriage 3 at positions corresponding to the opposite ends of the carriage 3, respectively, such that the rotary brushes 16 can enter a guide groove 17 formed in the front surface of the reed 1. The guide tubes 13 holding the rotary brushes 16 are flexible and moderately rigid, so that the rotary brushes 16 are able to move away from the front surface of each piece of the reed 1 when an excessive force acts thereon.

Supporting the flexible shafts 15 by the guide tubes 13 having the parts of a predetermined length extending from the support rods 12 toward the opposite ends of the reed 1, respectively, permit to hold the rotary brushes 16 at predetermined positions relative to the reed 1 in a normal operating state. The guide tubes 13 are able to move the rotary brushes 16 away from the front surface of the reed 1 when an external force that may damage the reed 1 acts between the rotary brushes 16 and the reed 1.

A front air duct 18 and a back air duct 19 are extended downward from the carriage 3 on the front and the back side of the reed 1, respectively. The front air duct 18 is provided at its lower end with a jetting opening 20 through which cleaning air is jetted toward the guide groove 17, and the back air duct 19 is provided at its lower end with a suction opening 21 through which cleaning air jetted through the jetting opening 20 is sucked.

When the reed cleaning apparatus cleans the reed 1, the front air duct 18 is connected to a compressed-air source and the back air duct 19 is connected through an air filter to a vacuum source to produce cleaning air currents that flows through the guide groove 17 of the reed 1. The cleaning air blows flies brushed off the dents by the rotary brushes 16 into the suction opening 21. Flies sucked through the suction opening 21 into the back air duct 19 are arrested by the air filter. Thus, the dents can be cleaned with reliability and the dispersion of flies brushed off the dents by the brushes 16 in the weaving mill can be reduced to the least possible extent.

When the reed cleaning apparatus is used for cleaning the reed 1, the loom is stopped, a pipe (or a bar) 23 is placed on warp yarns 22 extended through the reed to depress the warp yarns 22, and then the reed cleaning apparatus is mounted on the reed so that the reed cleaning apparatus is held on the upper bar 2 of the reed 1 with the rotary brushes 16 placed in the guide groove 17. The front air duct 18 provided with the jetting opening 20 is connected to the outlet of an air source by a flexible pipe, and the back air duct 19 provided with the suction opening 21 to the inlet of the air source by a flexible pipe. Then, the brush-driving motors 10 and the motor 8 are actuated to rotate the rotary brushes 16 and to move the carriage 3 along the upper bar 2 of the reed 1 for cleaning the reed 1.

A limit switch 24 is disposed at one longitudinal end of the carriage 3, and a stopper 25 is fastened to a proper part of the upper bar 2 of the reed 1 with a screw 26. When the limit switch 24 is actuated by the stopper 25, the brush-driving motors 10 and the motor 8 are reversed to reverse the carriage 3. Thus, the carriage 3 can be reciprocated along the reed 1. After a desired region of the reed 1 has been cleaned by a desired number of times, the rotary brushes 16 and the carriage 3 are stopped, the reed cleaning device is removed from the reed 1, the pipe 23 to depress the warp yarns is removed from the warp yarns, and the loom is started.

What is claimed is:

1. A reed cleaning apparatus for an air-jet loom supported on a carriage which moves along an upper bar arranged over a reed, including:

a brush mounted on the carriage to brush dents forming a guide groove in a front surface of the reed wherein the rotary brush is driven for rotation about an axis parallel to a inserting direction in which a weft yarn is inserted and is disposed with its rotary axis extended within the guide groove of the reed, and a jet nozzle for jetting cleaning air and a suction nozzle for sucking cleaning air jetted through the jet nozzle, which are disposed on the opposite sides, respectively, of the reed, close to the rotary brush with a jetting opening of the jet nozzle facing the guide groove in the front surface of the reed, and with a suction opening of the suction nozzle disposed opposite to the jetting opening, respectively.

2. The reed cleaning apparatus according to claim 1, wherein said rotary brush is driven for rotation with a flexible shaft.

3. The reed cleaning apparatus according to claim 1, wherein the diameter of said rotary brush is less than 16 mm.

4. The reed cleaning apparatus according to anyone of claims 1 to 3, wherein said rotary brushes are disposed in front and back end parts of the carriage, respectively, with respect to an advancing direction of the carriage.

* * * * *